US009670630B2

(12) United States Patent
Berning et al.

(10) Patent No.: US 9,670,630 B2
(45) **Date of Patent: *Jun. 6, 2017**

(54) SELF-PROPELLED BUILDING MACHINE

(71) Applicant: Wirtgen GmbH, Windhagen (DE)

(72) Inventors: Christian Berning, Brühl (DE); Dirk Franzmann, Hennef (DE); René Müller, Vettelschoss (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/663,518

(22) Filed: Mar. 20, 2015

(65) Prior Publication Data

US 2015/0252539 A1 Sep. 10, 2015

Related U.S. Application Data

(63) Continuation of application No. 13/790,515, filed on Mar. 8, 2013, now Pat. No. 8,998,344.

(30) Foreign Application Priority Data

Oct. 19, 2012 (DE) ..... 10 2012 020 655

(51) Int. Cl.
*E01C 23/088* (2006.01)
*E01C 23/12* (2006.01)
*E01C 19/00* (2006.01)

(52) U.S. Cl.
CPC ..... *E01C 23/088* (2013.01); *E01C 23/127* (2013.01); *E01C 19/004* (2013.01)

(58) Field of Classification Search
CPC ..... E01C 19/004; E01C 19/006; E01C 23/127
(Continued)

(56) References Cited

U.S. PATENT DOCUMENTS 3,423,859 A 1/1969 Swisher, Jr. et al.
3,598,027 A 8/1971 Swisher, Jr.
(Continued)

FOREIGN PATENT DOCUMENTS

DE 3812809 A1 11/1989
DE 102006020293 A1 11/2007
(Continued)

OTHER PUBLICATIONS

European Search Report in corresponding EP Application EP 13186534, dated Jan. 22, 2014, 2 pp. (not prior art).

*Primary Examiner* — John Kreck
*Assistant Examiner* — Michael Goodwin
(74) *Attorney, Agent, or Firm* — Lucian Wayne Beavers; Patterson Intellectual Property Law, PC

(57) ABSTRACT

A road cutting machine has a machine frame and at least one left-hand running gear and at least one right-hand running gear. A device is provided for raising or lowering the running gears resting on the ground, in relation to the machine frame, and also a control unit is provided for activating the device for raising and lowering the running gears, so that the height of the running gears can be adjusted to the machine frame. The control unit comprises sensors for detecting changes in the height of the ground to be covered by the running gears in relation to the machine frame, whereby the control unit contains a control mode for initiating actions in the control system for adjusting the height of the running gears. The control unit is configured in such a way in the control mode that if a change is detected in the height of the ground, the respective running gear or the respective running gears are raised or lowered so as to compensate any lateral tilting due to a change in the height of the ground.

27 Claims, 9 Drawing Sheets

(58) Field of Classification Search
USPC ..... 299/1.5, 36.1, 39.1, 39.2, 39.4, 39.6
See application file for complete search history.

(56) References Cited

U.S. PATENT DOCUMENTS

| | | | |
|---|---|---|---|
| 3,674,094 | A | 7/1972 | Kuntz |
| 3,946,506 | A | 3/1976 | Snow, Jr. et al. |
| 4,139,318 | A | 2/1979 | Jakob et al. |
| 4,325,580 | A | 4/1982 | Swisher, Jr. et al. |
| 4,943,119 | A | 7/1990 | Zarniko et al. |
| 5,309,407 | A | 5/1994 | Sehr et al. |
| 5,315,770 | A | 5/1994 | Campbell |
| 5,378,081 | A | 1/1995 | Swisher, Jr. |
| 5,607,205 | A | 3/1997 | Burdick et al. |
| 5,639,181 | A | 6/1997 | Swisher, Jr. |
| 5,893,677 | A | 4/1999 | Haehn et al. |
| 5,984,420 | A | 11/1999 | Murray et al. |
| 6,371,566 | B1 | 4/2002 | Haehn |
| 7,946,788 | B2 | 5/2011 | Jurasz et al. |
| 8,113,592 | B2 | 2/2012 | Busley et al. |
| 8,246,270 | B2 | 8/2012 | Berning et al. |
| 8,308,395 | B2 | 11/2012 | Jurasz et al. |
| 8,511,932 | B2 | 8/2013 | Jurasz et al. |
| 8,690,474 | B2 | 4/2014 | Jurasz et al. |
| 8,807,867 | B2 | 8/2014 | Berning et al. |
| 2002/0047301 | A1 | 4/2002 | Davis |
| 2007/0098494 | A1 | 5/2007 | Mares |
| 2007/0286678 | A1 | 12/2007 | Berning et al. |
| 2008/0152428 | A1 | 6/2008 | Berning et al. |
| 2008/0153402 | A1 | 6/2008 | Arcona et al. |
| 2009/0108663 | A1 | 4/2009 | Berning et al. |
| 2010/0109422 | A1 | 5/2010 | Busley et al. |
| 2011/0266858 | A1 | 11/2011 | Laux et al. |
| 2012/0104828 | A1* | 5/2012 | Grathwol ..... 299/1.5 |
| 2012/0179339 | A1 | 7/2012 | Busley et al. |
| 2012/0301220 | A1* | 11/2012 | Snoeck et al. ..... 404/75 |
| 2013/0080000 | A1* | 3/2013 | Von der Lippe et al. ..... 701/50 |
| 2013/0162004 | A1* | 6/2013 | Killion ..... E01C 23/088 299/1.5 |
| 2014/0097665 | A1* | 4/2014 | Paulsen et al. ..... 299/39.4 |

FOREIGN PATENT DOCUMENTS

| | | | |
|---|---|---|---|
| DE | 102006062129 | A1 | 7/2008 |
| DE | 102010014893 | A1 | 10/2011 |
| EP | 1154075 | A2 | 11/2001 |
| WO | 2007031531 | A1 | 3/2007 |

* cited by examiner

| $Fw_L$ | $Fw_R$ | $N_L$ | $N_R$ | $KS_L$ | $KS_R$ |
|---|---|---|---|---|---|
| 1 | 1 | x | | | |
| 1 | 1 | | x | | |
| 1 | 0 | x | | ← | |
| 1 | 0 | x | | | → |
| 0 | 1 | | x | | ← |
| 0 | 1 | | x | → | |
| 0 | 0 | x | | | |
| 0 | 0 | | x | | |

↑ ↑ ↑ ↑ ↑ ↑ ↑ ↑

| $Fw_L$ | $Fw_R$ | Fig. 4A/B |
|---|---|---|
| $\underline{0}$ | 1 | E |
| 1 | $\underline{0}$ | A |
| $\underline{0}$ | 0 | B |
| 1 | $\underline{1}$ | H |
| 0 | $\underline{0}$ | F |
| $\underline{1}$ | 1 | D |
| 0 | $\underline{1}$ | C |
| $\underline{1}$ | 0 | G |

Fig. 6

SELF-PROPELLED BUILDING MACHINE

BACKGROUND OF THE INVENTION

1. Field of the Invention

The present invention relates to a self-propelled building machine, in particular a road cutting machine, having a machine frame and a running gear, which comprises at least one steerable front running gear, at least one rear left-hand running gear in the direction of working and at least one rear right-hand running gear in the direction of working. Additionally, the present invention relates to a process for operating such a building machine.

2. Description of the Prior Art

The above building machines comprise a working device having a working roller, which can be in the form of a milling or cutting roller. In known building machines, the operating depth of the working roller can be adjusted at least by adjusting the height of the rear running gears in the direction of working in relation to the machine frame resting on the ground in the direction of working.

When cutting into the ground, a road cutting machine is in general operated with the running gear in a raised position in relation to the machine frame, so that the cutting roller, at a given position of the cutting roller axis in relation to a reference plane, penetrates the ground. Under normal conditions, the reference plane is represented by the still uncut surface of the ground. For this reason, known building machines comprise devices to regulate the cutting depth in relation to the surface currently being worked by the machine.

However, in practice, cases can occur in which a machine has to rework a piece of ground that has already been partially cut. This can happen, for example, if a road has in the first instance undergone a large-scale cutting operation and subsequently has to undergo a small-scale cutting operation. If there are obstacles, for example a manhole cover, that prevent the ground from being worked with the large-scale cutting cutter, the cutting cutter has to be removed and replaced after the obstacle. This produces sections in which the ground has either been cut or has not been cut, with the result that there are differences in the heights of the individual sections and sudden gaps occur between these sections. The desired result then usually consists in adjusting the height of the covering to a level that corresponds to a section of ground that has already been cut. However, this cannot be done with existing known cutting depth adjustments.

The framework conditions described can, for example, lead to an operating condition in which the left hand running gear is lowered in relation to the frame of the machine, as it rests on a part of the ground that has already been cut, while the right-hand running gear is in a raised position, resting on a part of the ground that has not been cut with the result that although the machine is still effectively parallel to the ground surface, the axis of the cutting roller follows the direction of the reference plane. In this way, the non-cut section of the ground is adjusted to the required surface level, while the ground below is not subjected to any further treatment.

In the same way, operating situations can arise, in which the right-hand running gear is lowered in relation to the machine frame, while the left hand running gear is raised in relation to the machine frame. Furthermore, operating situations can arise in which both running gears are lowered in relation to the machine frame, so that the cutting roller is no longer in contact with the ground, because it is completely above the cut ground level.

These operating conditions cannot be addressed by the known cutting depth regulation systems, as in order to determine the working depth, all that needs to be done is to adjust the position of the working roller in relation to the surface that is currently being treated so that the ground that has already been cut is treated. This means that any necessary adjustments to the control systems of the known machines must be carried out manually by the user. This requires a high level of attention and concentration on the part of the user in addition to his other responsibilities, such as maintaining the cutting track

SUMMARY OF THE INVENTION

The aim of the present invention is thus to propose a building machine that provides a user-friendly and a more ergonomic operation even where sudden changes in the ground level occur in front of the running gears.

A further aim of the present invention is to propose a method that enables a building machine to be operated in the face of sudden changes in the level of the ground surface while maintaining the position of the cutting roller axis constant in relation to a reference plane.

According to the present invention, these aims are achieved by the features contained in the independent claims below. The objects of the dependent claims represent preferred embodiment of the present invention.

The building machine according to the present invention, in particular a road cutting machine, comprises a device by which the running gears that rest on the ground can be raised or lowered in relation to the machine frame and also a control unit to operate the device for raising or lowering the running gears, so that the height of the running gears can be adjusted in relation to the machine frame.

The building machine according to the present invention is characterised by the fact that the control unit comprises a means for identifying any changes in the height of the ground being worked by the running gears in relation to the machine frame, whereby the control unit contains a control mode for controlling the adjustment of the height of the running gears. In the control mode, the control unit is configured in such a way that when a change is detected in the level of the surface, the device for raising or lowering the running gears is operated in such a manner that the respective running gear or mechanisms are raised or lowered in order to counter any tilting of the machine and thereby of the cutting roller as a result of a change in the height of the surface. As, when there is a variation in the height of the ground surface, the control unit comprises a special control mode, the building machine can be operated with the cutting roller axis in relation to a reference plane even if the height of the ground surface, on which the running gears rest changes in relation to the machine frame. The change of the level of the ground can be due to a shoulder or a depression on the left or the right-hand side of the machine in the direction of working.

The control system according to the present invention is particularly advantageous in the event of sudden changes in the ground level. These can occur as the ground changes from a cut to an uncut surface. In this way, it is possible to work the ground as if there were no differences in the height and the surface were completely uniform.

The means for detecting changes in the height of the surface can be in different forms. A change in the height of the surface can be detected by analysing the quality of the surface of the ground. This can be done, for example, by using a camera to study the surface of the ground and identifying changes in the surface by processing the images. Otherwise, the height of the surface in relation to the machine frame can also be determined by using a sensor, for example an ultrasound sensor.

However, changes in the ground surface can preferably be determined by the reaction of the building machine to such changes. For example, it is possible to identify driving over an edge section by the movement of parts that have been movably arranged on the roller housing, such as pressure elements, scrapers or edge protectors, in relation to the machine frame.

Building machines with two front running gears usually contain a floating axis. Because of the rigid connection between the front and also between the rear running gears through the machine frame, any changes in the ground level can be detected in the rear running gears by monitoring the reaction of the front running gears.

Furthermore, any changes in the ground level can be detected by calculating the tilting movement of the building machine. For this purpose, the means to identify changes in the ground level can also include a means of determining the angle of inclination of the machine frame in the direction of travel and/or transversely in relation to the direction of travel. An embodiment comprising a sensor for both longitudinal and transverse inclination can also enable edges diagonally in relation to the direction of travel to be detected. Sensors for longitudinal and transverse inclinations can also enable a range of control functions to be carried out.

In a preferred embodiment of the present invention, the means to detect changes in the ground level include means to detect a lateral inclination of the building machine. Preferably, such means to detect a lateral inclination of the building machine include an inclination sensor mounted on the machine frame.

One particularly advantageous embodiment of the present invention comprises means that can not only identify the ground level but can also determine whether the ground level increases or reduces in relation to the machine frame in the direction of working, in other words, whether the running gear in question is approaching a shoulder or a depression in the ground. In this way, a counter-reaction on the part of the machine can be devised for all possible situations so that tilting movements in response to changes in the ground level can be compensated.

In another particularly advantageous embodiment of the present invention, any increase or reduction in the ground level in the direction of working is identified by determining the position and/or the movement of the left hand and/or the right-hand edge protection of the building machine. For this reason, the means in a particularly favourable embodiment of detecting an increase or a reduction of the ground level comprise a sensor that can calculate the height of the left hand and/or the right-hand edge protection in relation to the machine frame. In particular, in the event of a sudden change in the ground level on just one side of the building machine, the position or the movement of the edge protection immediately after the response of the building machine gives an indication of whether the running gear in question is climbing onto a shoulder or descending into a depression in the ground.

If, in one embodiment with a longitudinal inclination sensor, the left and right-hand running gears drive into a depression, the longitudinal inclination sensor will detect a change in the inclination to the rear and at the same time the edge protection on the left and on the right sides will be raised, so that the machine control system is activated and the left and right-hand running gears are lowered. If, on the other hand, the left and right-hand running gears encounter a shoulder in the ground, the longitudinal inclination sensor will detect a change in the inclination to the front and at the same time the edge protection on the left and the right sides will be lowered, so that the machine control system is activated and the left and right-hand running gears are raised.

In principle, instead of the height of the edge protection in relation to the machine frame, the height of a scraper in the direction of working arranged behind the working device or even the height of a pressure element for the building machine in the direction of working arranged in front of the working device can be calculated. Alternatively, an increase or a reduction of the ground level can be detected by means of a sensor calculating the longitudinal inclination of the machine frame.

In a further preferred embodiment of the present invention, the control unit comprises different operating conditions, each with a certain allocated reaction, whereby the reaction of the building machine consists in the raising or the lowering of the at least one left hand and/or of the at least one right-hand running gear. As the reactions in question of the building machine are clearly allocated to the respective changes in the operating conditions, the necessary control commands are set in advance in a memory in the control unit. Subsequently, only the respective changes in condition need to be determined and the running gears raised or lowered in accordance with a predetermined programme.

In a further embodiment of the present invention, the means for detecting a change in the height of the ground immediately in front of the running gears comprise at least one non-contacting sensor to determine the distance between a reference point in relation to the machine frame and the ground. Similarly, the means for determining an increase or a reduction in the level of the ground can comprise at least one non-contacting sensor, by means of which the distance between a reference point on the machine frame and the ground surface can be determined. In principle, a single sensor enabling any changes in the height of the ground in front of the running gears to be detected and also indicating whether the building machine is approaching a shoulder or a depression in the ground is sufficient.

BRIEF DESCRIPTION OF THE DRAWINGS

The present invention is explained in greater detail below by means of an embodiment in conjunction with the following figures.

These figures show.

DETAILED DESCRIPTION

Figure 1:
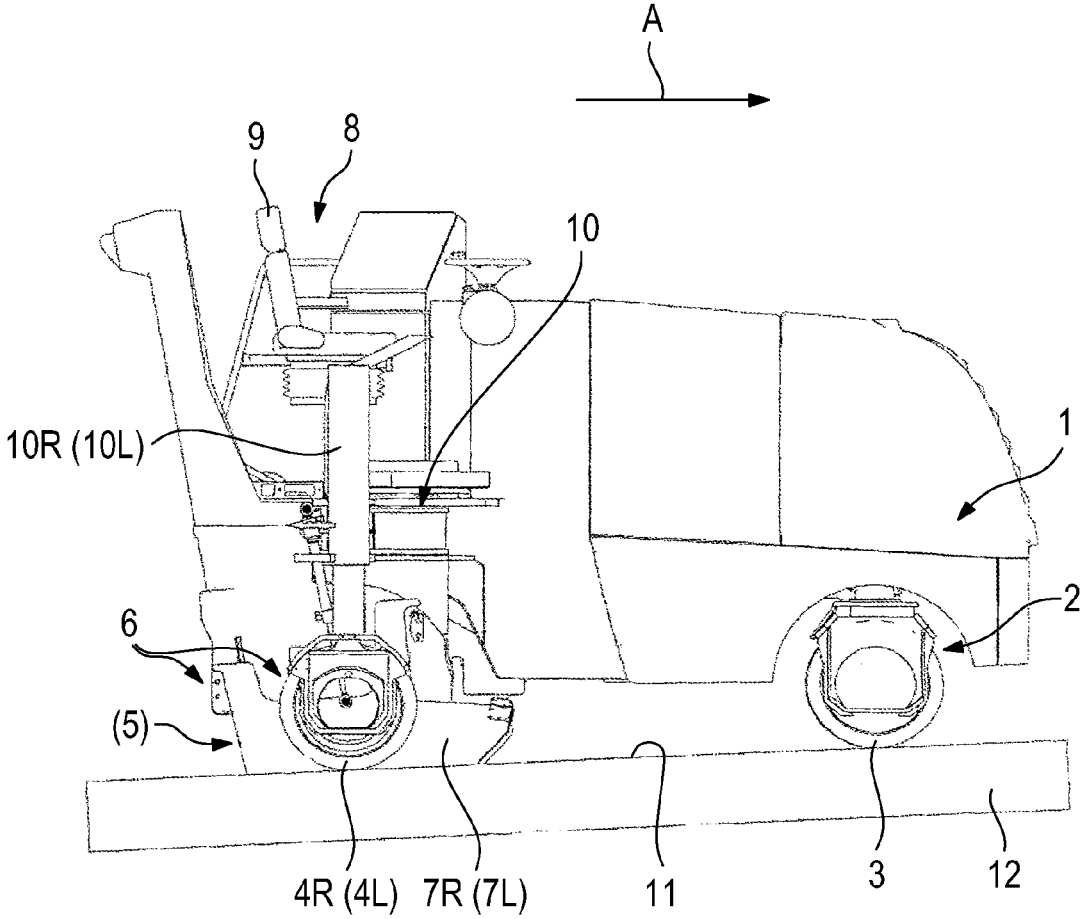
FIG. 1 a side view of a road cutting machine.

FIG. 1 shows a side view of an embodiment of a road cutting machine, in this case a small-scale road cutting machine. The road cutting machine comprises a machine frame 1, on which the chassis 2 is mounted. The chassis comprises a centrally arranged front running gear 3 and a rear right-hand running gear 4R and a rear left-hand running gear 4L. It is clear that, instead of a centrally arranged front running gear, there could be a front left-hand and a front right-hand running gear. The said running gears are in the form of wheels, although they can also be chain driven systems.

The road cutting machine comprises a working device with a working roller, which is in the form of a cutting roller. The cutting roller 5 is arranged in a cutting roller housing 6, that is closed in the working direction A on both the left and the right side by an edge protection 7R (7L). Above the cutting roller housing 6 is the operator's cab 8 with the operator's seat 9.

The road cutting machine further comprises a device 10 for raising or lowering the rear right-hand and left-hand running gears 4R (4L), which are resting on the ground, in relation to the machine frame 1. The device 10 for raising or lowering the running gears comprises a lifting device 10R that is allocated to the right-hand running gear and a lifting device (100 that is allocated to the left-hand running gear (4L).

The cutting roller (5), together with the left-hand running gear (4L), the left-hand edge protection (7L) and the left-hand lifting device (10L) are not visible in FIG. 1.

To set the cutting depth, the rear running gears of the road cutting machine are adjusted in relation to the machine frame so that the cutting roller can penetrate the ground.

Figure 2A:
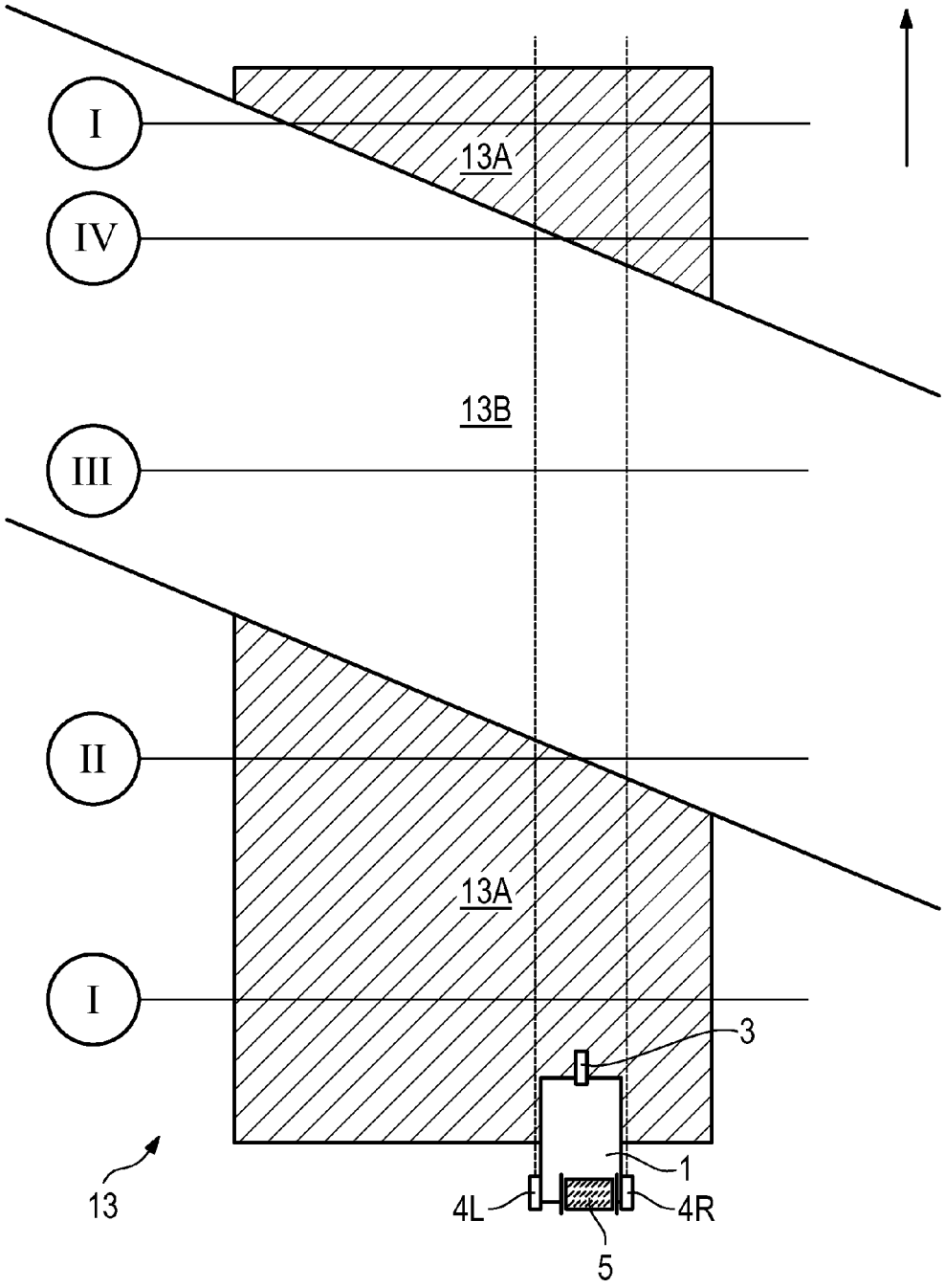
FIG. 2A the movement of the road cutting machine shown in FIG. 1 in a simplified schematic form on an area of ground, in which an initial section has already been cut, FIG. 2B the movement of the road cutting machine shown in FIG. 1 on an area of ground in which a second section has already been cut, FIG. 3A a road cutting machine in a simplified schematic form, with the left and right-hand running gears in a raised position, FIG. 3B a road cutting machine, in which the left-hand running gear is raised and the right-hand running gear is lowered, FIG. 3C a road cutting machine, in which both the left-hand and the right-hand running gears are lowered, FIG. 3D a road cutting machine, in which the left-hand running gear is lowered and the right-hand running gear is raised, FIG. 4A the movement of a building machine over a non-cut section to demonstrate the control mode for adjusting the height of the running gears at the transition from cut and non-cut sections, FIG. 4B the movement of a building machine to demonstrate the control mode, FIG. 5 a simplified block circuit diagram of the control unit of a road cutting machine together with a simplified representation of the device for raising and lowering the running gears, and FIG. 6 a table showing the calculated changes in the condition of the road cutting machine and the individual control actions that are allocated to the individual changes of condition in order to adjust the height of the running gears.
Figure 2B:
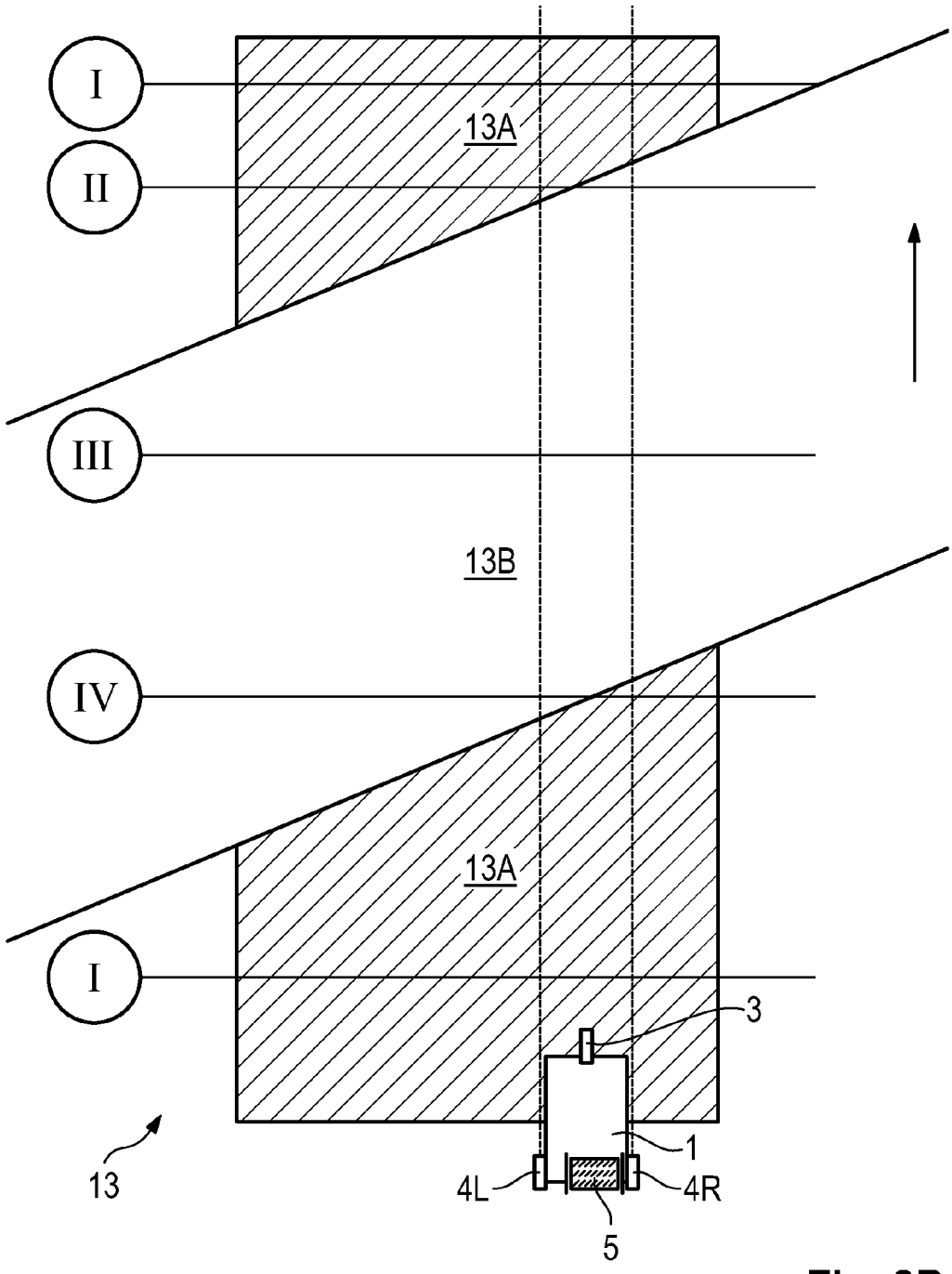

The following, in relation to the FIGS. 2A and 2B, describes the movement of the building machine on an area of ground that comprises a non-cut section 13A and a cut section 13B. In FIG. 2A, the cut section is in the form of a strip, extending from top left to bottom right, while in FIG. 2B the cut section extends from bottom left to top right. At those points, at which the uncut section 13A crosses into the cut section 13B or vice versa, there is a sudden change in the height of the ground in relation to the machine frame 1. When, for example, the road cutting machine moves from the non-cut section 13A into the cut section 13B, the ground level reduces suddenly and it also increases suddenly when the road cutting machine moves from the cut section 13B into the non-cut section 13A.

FIGS. 2A and 2B show the road cutting machine with the machine frame 1 and the rear running gears 4R and 4L and the cutting roller 5 in a notional manner only. The road cutting machine moves along a track shown as a broken line. The individual positions of the building machine are shown by the numbers I to IV. Number I indicates the position, at which the road cutting machine moves along the non-cut section, while number III indicates the position, at which the road cutting machine moves along the cut section. The points at which the ground height differs for the left and the right-hand running gears are indicated by numbers II and IV respectively.

From the FIGS. 2A and 2B, it is clear that, at the positions II and IV, where the ground height differs, the left-hand and respectively the right-hand running gear firstly approaches the higher or the lower level, as the cut section 13B runs obliquely against the non-cut section, whereupon, as a result of the different orientation of the cut section (FIG. 2A and FIG. 2B), different constellations arise. These are described below.

FIGS. 3A to 3D show the positions that can be taken up by the running gears. The corresponding parts of the building machine have again been given the same reference marks.

Figure 3A:
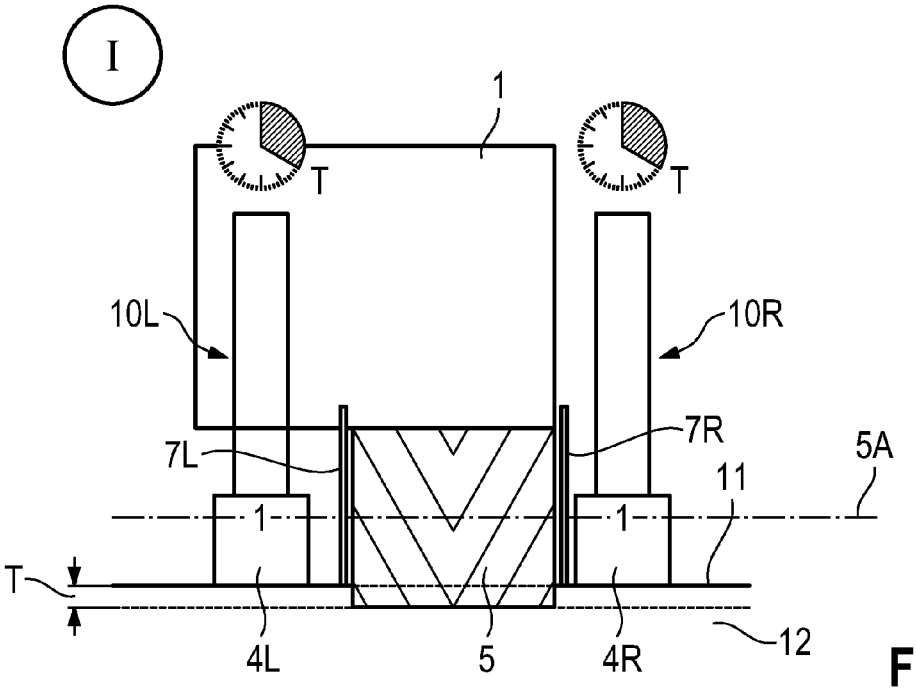

FIG. 3A shows the raised positions occupied by the rear left and right-hand running gears 4L and 4R on the surface 11 of the ground 12 in the as yet uncut section 13A in relation to the machine frame 1, so that the working roller 5 penetrates the ground to a working depth T in relation to the ground surface 11 of the non-cut section 13A. In this way, the axis 5A of the working roller 5 has a specific position in relation to the ground surface of the non-cut section.

FIGS. 3A to 3D show the left-hand edge protection 7L in a working direction and the right-hand edge protection 7R of the building machine. The left-hand and the right-hand edge protections 7L and 7R are mounted in a floating manner on the machine frame 1, so that the edge protection rests on the ground and follows the height of the ground as the road cutting machine advances.

Figure 3B:
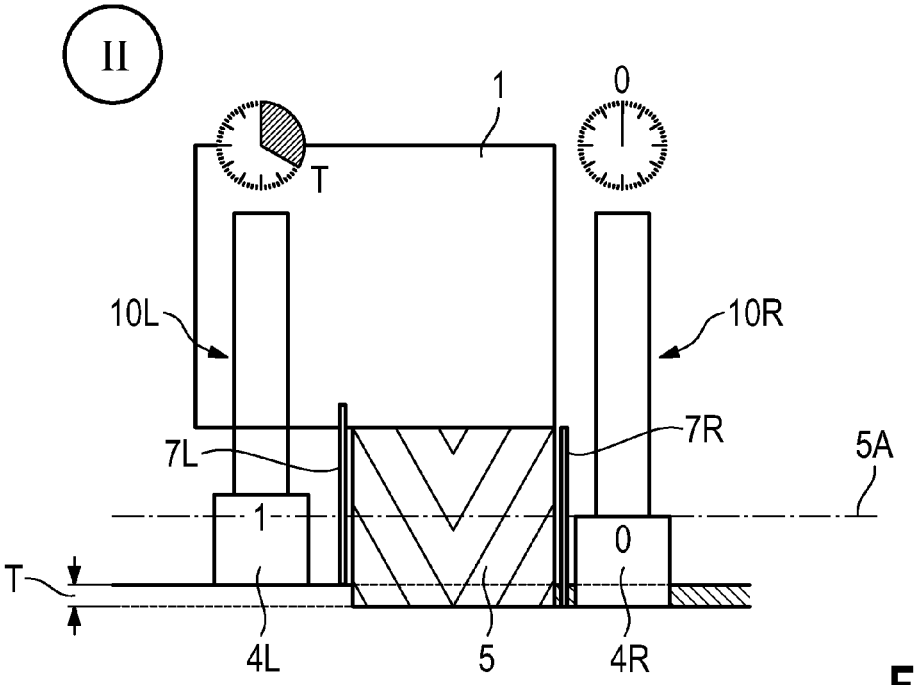
Figure 3C:
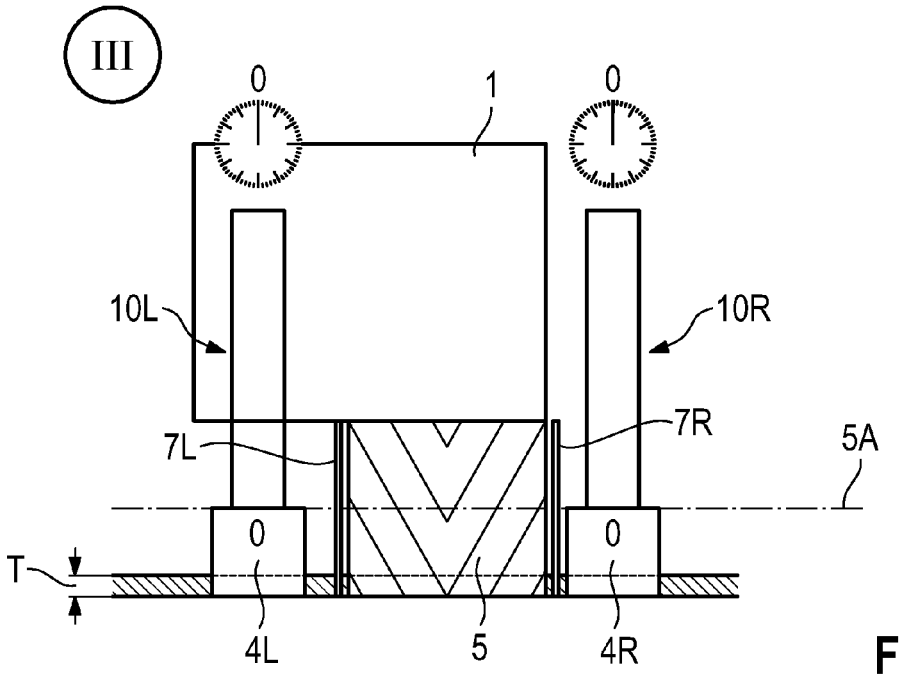
Figure 3D:
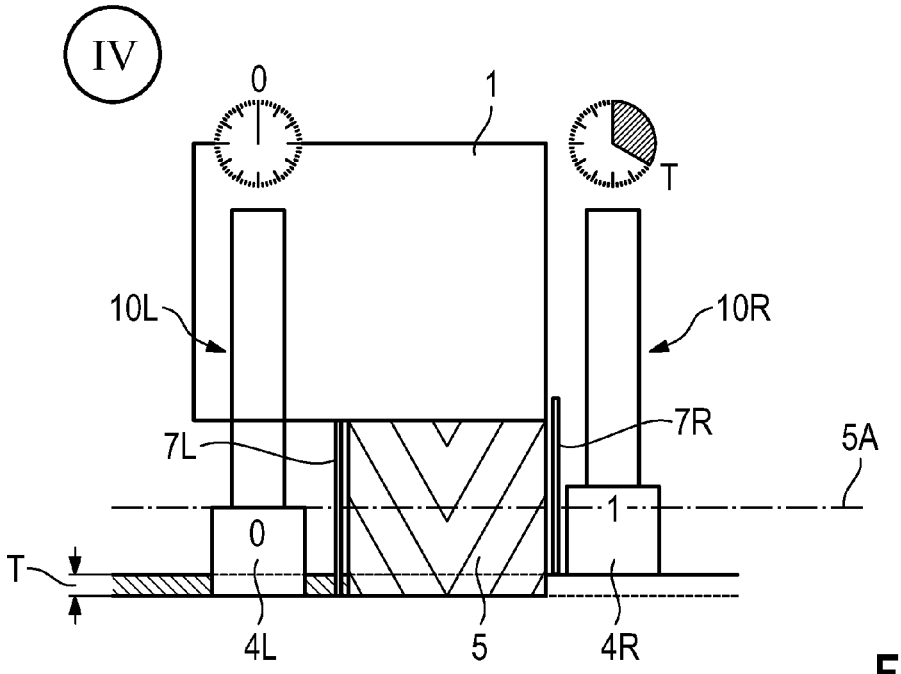

The position of the running gear 4 shown in FIG. 3A represents the position occupied by the running gears when the road cutting machine is in the position I shown in FIGS. 2A and 2B. The FIGS. 3B, 3C and 3D show the position of the running gears in the positions II, III and IV of FIGS. 2A and 2B.

It can be assumed that the road cutting machine moves towards the cut section from top left to bottom right (FIG. 2A). At the outset, both running gears 4L, 4R are in a raised position (FIG. 3A). FIG. 3B shows the corrected position of the running gears 4L, 4R in the position II, whereby the left-hand running gear 4L is still positioned on the higher part of the non-cut section 13A and the right-hand running gear 4R is already on the lower level of the cut section 13B. At this point, the position of the working roller corresponds to the predetermined working depth T in relation to the ground surface 11 of the non-cut section 13A, while the left-hand running gear 4L is raised in relation to the machine frame and the right-hand running gear is lowered. At this point, the machine frame is in a horizontal position. However, this anticipates the correction of the height adjustment in the transition from the non-cut section to the cut section, which is described below in greater detail. In comparison with FIG. 3A, the position of the cutting roller axis 5A in relation to the surface of the non-cut section remains constant.

Figure 4A:
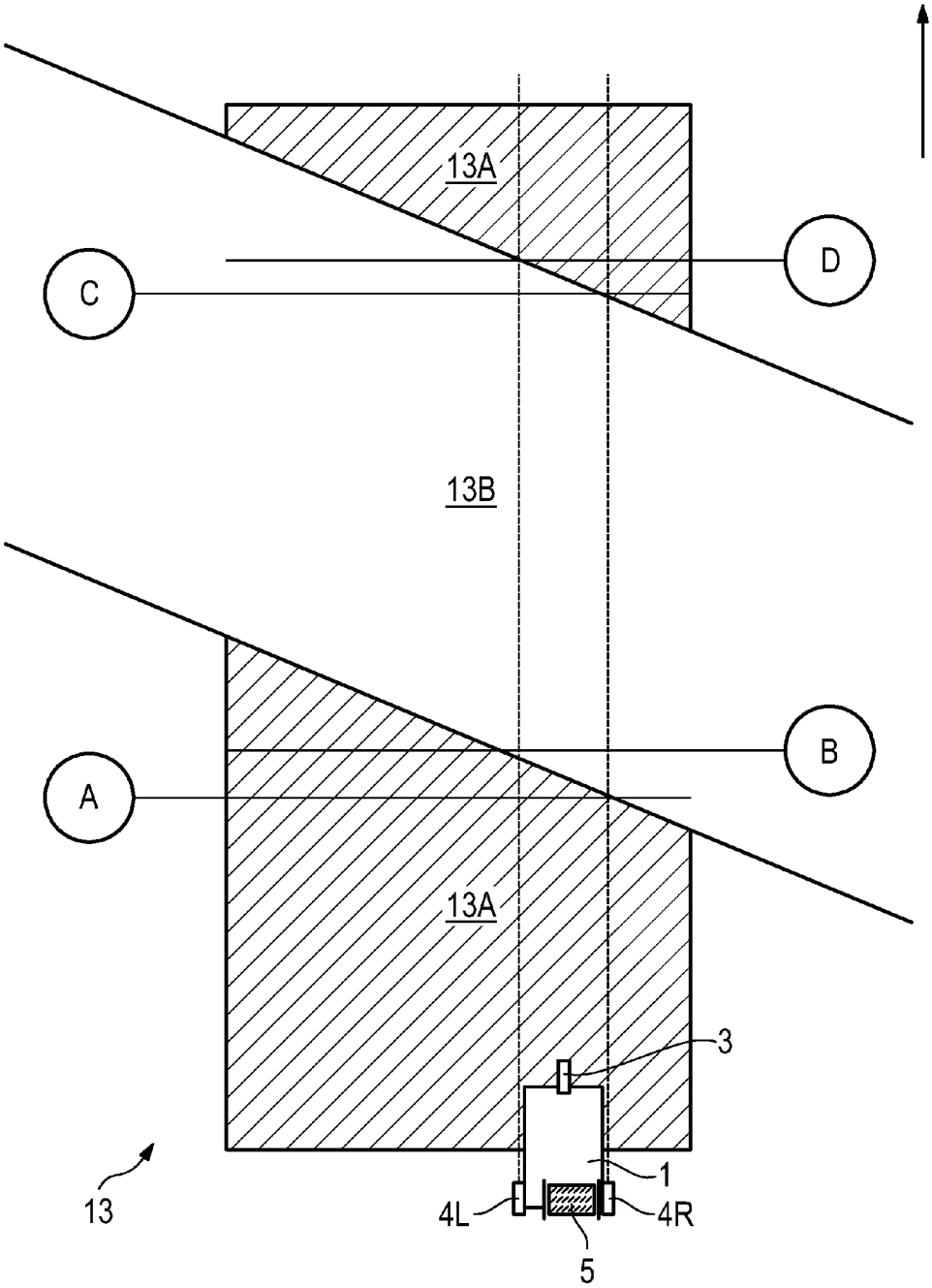
Figure 4B:
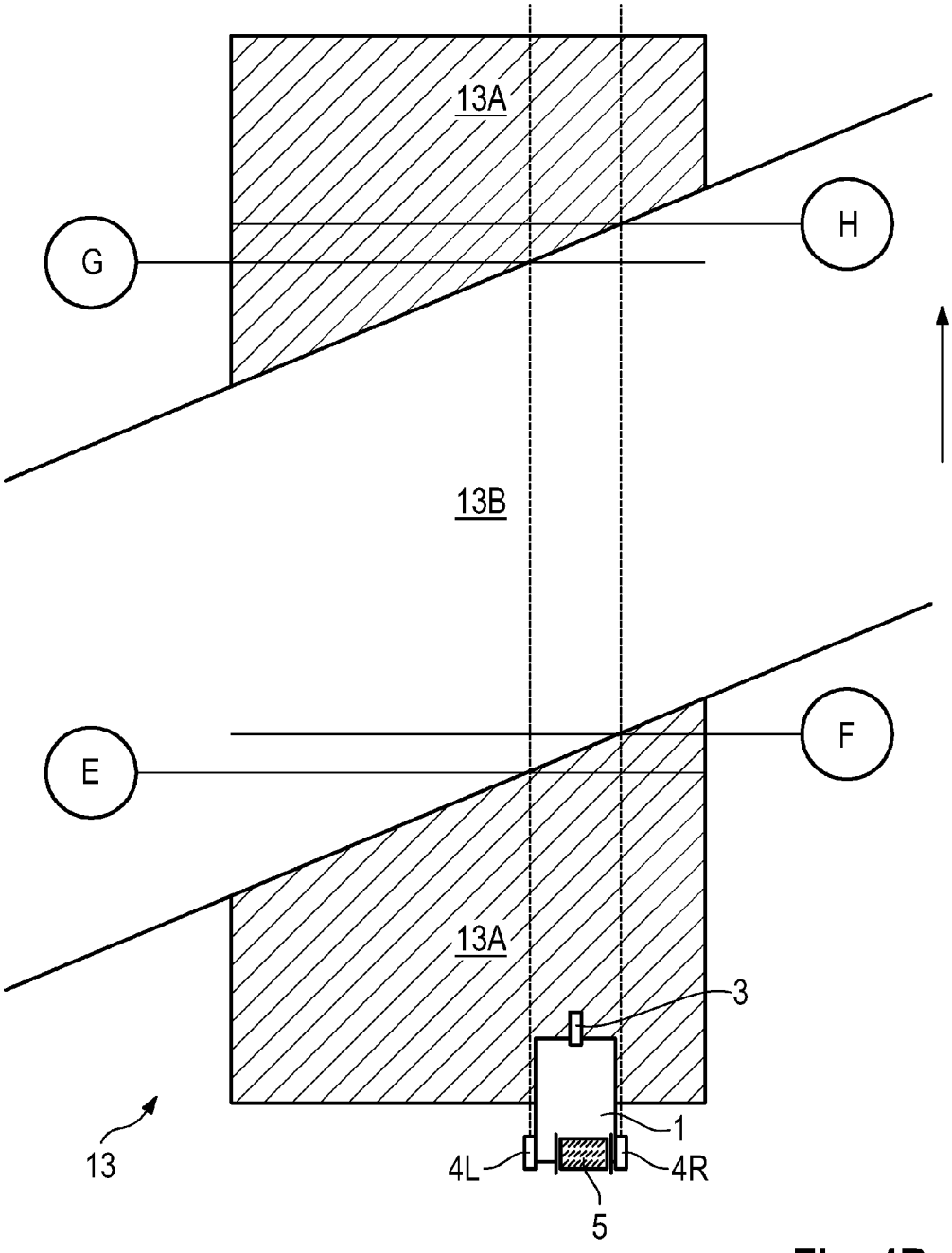

FIGS. 4A and 4B show the positions A, B, C, D, E, F, G and H, in which the left-hand and the right-hand running gear 4L, 4R find themselves precisely at the transition between the non-cut and the cut section or vice versa.

If, for example, the running gears are in the appropriate position (FIG. 3A) and the road cutting machine travels from the non-cut section 13A to the cut section 13B, the right-hand running gear 4R will lose contact with the ground, so that the machine frame 1 of the road cutting machine starts to tilt to the right. In order to compensate this tilting movement, the right-hand running gear 4R is lowered in relation to the machine frame 1 from its position 1 shown in FIG. 3A along a path corresponding to the cutting depth T into the position 0 shown in FIG. 3B. During this time, the height of the left-hand running gear 4L remains unchanged. In this way, the machine frame remain in a horizontal position and the position of the cutting roller axis in relation to the surface 11 of the non-cut section is maintained.

If the road cutting machine proceeds a little further, so that the left-hand running gear 4L reaches the position B (FIG. 4A), the left-hand running gear 4L will lose contact with the ground as the machine moves forward, so that the machine frame 1 starts to tilt to the left. In order to straighten the position of the machine frame and thereby the axis of the cutting roller in relation to the surface 11 of the non-cut section 13A, the left-hand running gear is now also lowered in relation to the machine frame (FIG. 3C).

The movement of the running gears in the different positions takes place in a similar manner, with the tilting movements of the machine frame and the movements of the machine frame occurring accordingly. For example, the road cutting machine tilts to the right if the left-hand running gear 4L passes over the position G (FIG. 4B). Consequently, the left-hand running gear 4L is raised, i.e. retracted, in order to return the machine to its horizontal position.

Figure 5:
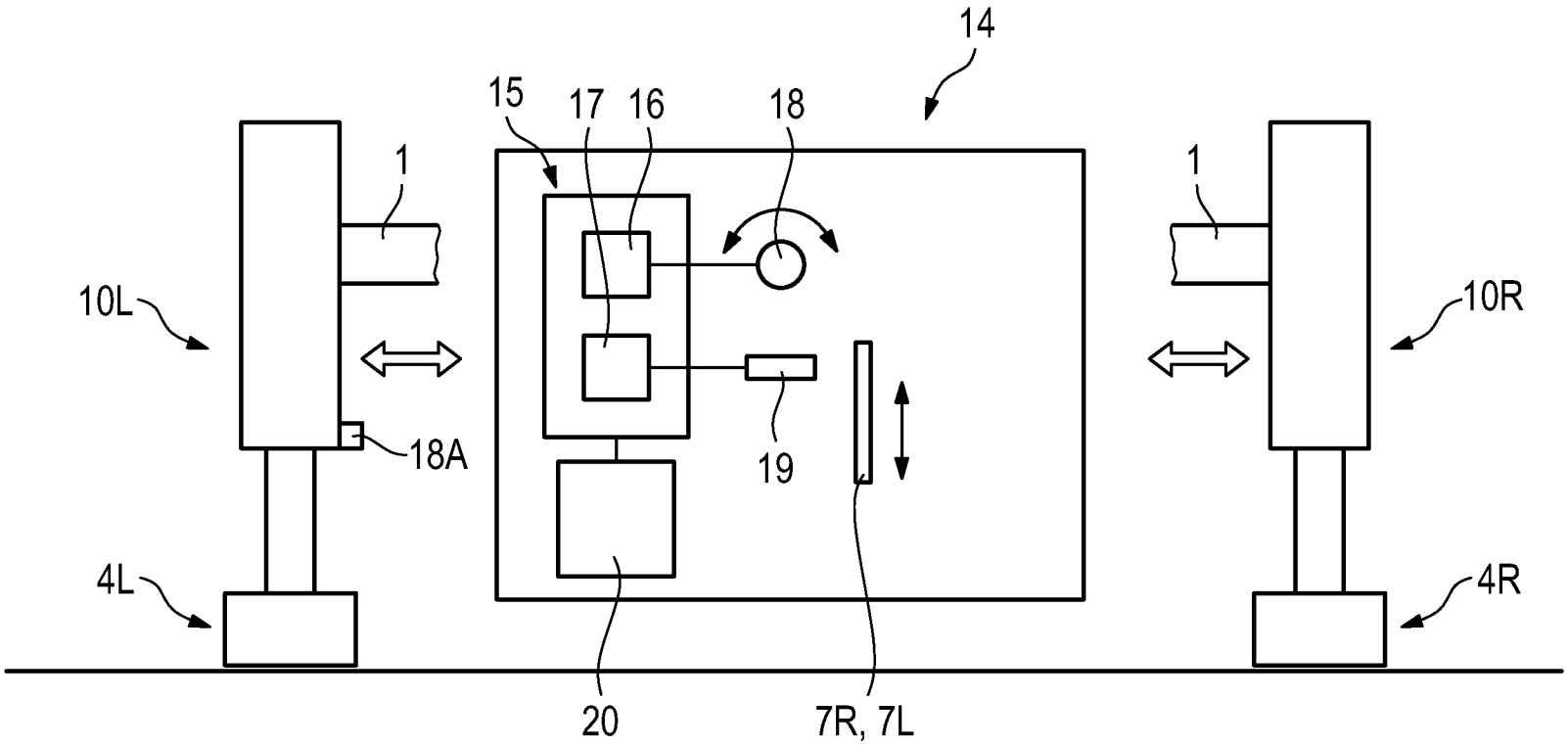

The construction and the functioning of the control unit 14 are individually described by means of the FIGS. 5 and 6. The respective parts are again all indicated by means of the same references.

The control unit comprises means 15 for detecting changes in the height of the ground being covered by the left and right-hand running gears 4L, 4R, which means 15 further comprise means 16 for the detection of a lateral inclination. In the present embodiment, the tilting movement is detected by an inclination sensor 18, which is mounted on the machine frame 1. If the height of the surface changes, the machine frame will tilt to the right or to the left and this is detected by the inclination sensor 18 (positions A to H).

Furthermore, the means 15 for detecting changes in the height of the surface also comprises means 17 that allow any increase or reduction of the surface in the direction of working to be detected. These means 17 comprise a sensor 19 to calculate the position or the movement of the left and/or the right-hand edge protection 7L, 7R.

Alternatively or additionally, the means 15 for detecting changes in the height of the ground to be covered by the running gears and the means 17 for detecting any increase or reduction in the height of the surface comprise at least one non-contacting sensor 18A for determining the distance between a reference point in relation to the machine frame 1 and the surface of the ground. This non-contacting sensor is also shown notionally in FIG. 5.

The means 16 for detecting a lateral inclination of the road cutting machine generate an initial control signal NL, if the road cutting machine tilts or is tilted to the left and a second control signal NR, if the road cutting machine tilts or is tilted to the right. The means 17 for detecting any increase or reduction in the height of the ground generate a third control signal, if the height of the ground increases in the working direction, that is to say if the running gear approaches a shoulder in the ground and a fourth signal if the height of the ground reduces in the working direction, that is to say if the running gear approaches a depression in the ground.

The control unit 14 controls the lifting devices 10R and 10L in the control mode in order to activate the height adjustment in relation to the first, second, third or fourth control signal in such a way that the positions shown in the figures are adopted and, directly before, during or after the tilting movement of the building machine, the running gears 4L and 4R are raised or lowered in relation to the machine frame 1, thus maintaining or restoring the position of the cutting roller axis in relation to the surface of the ground 11 in the uncut section 13A. As a result of the four control signals, the following operating conditions are generated.

In the operating condition, in which the at least one left-hand and right-hand running gear are raised (FIG. 3A), the control unit 14 activates the device 10L, 10R in order to raise or lower the running gears 4L, 4R in such a way that the at least one left-hand running unit 4L is lowered if the control unit receives the first control signal or the control unit activates the device for raising or lowering the running gears in such a way that the at least one right-hand running gear is lowered if the control unit receives the second control signal.

In the operating condition in which the at least one left-hand and one right-hand running gear are lowered (FIG. 3C), the control unit activates the device for raising and lowering the running gears in such a way that the at least one right-hand running gear is raised if the control unit receives the first control signal or the at least one left-hand running gear is raised when the control unit receives the second control signal.

If the at least one left-hand running gear is raised and the at least one right-hand running gear is lowered (FIG. 3B), the control unit activates the device for raising and lowering the running gears in such a way that the at least one left-hand running gear is lowered when the control unit receives the first and fourth control signal, or the at least one right-hand running gear is raised if the control unit receives the first and the third control signals.

If the at least one left-hand running gear is lowered and the at least one right-hand running gear is raised (FIG. 3D), the at least one right-hand running gear is lowered when the control unit receives the second and the fourth control signal, or the at least one left-hand running gear is raised when the control unit receives the second and the third control signal.

FIG. 6 shows, in the form of a left-hand and a right-hand table, the individual operating conditions that can arise (left-hand table) and the subsequent control actions within the control mode to correct the height adjustment (right-hand table) that are taken by the control unit 14. There are 8 possible operating conditions to which control actions can be clearly allocated, which can produce a raising (0→1) or a lowering (1→0) of the right-hand or the left-hand running gear 4L and 4R (FIGS. 4A and 4B). In this way, the sensor provides the corresponding control signals, which are processed by the control unit 14.

The control unit 14 comprises a memory 20, in which a specific control action is allocated to each possible operating condition. This allocation is shown in the two tables in FIG. 6.

In FIG. 6, the position of the left-hand running gear is represented by $F_{WL}$ and that of the right-hand running gear by $F_{WR}$, whereby the raised position of the running gear in relation to the machine frame 1 is indicated by the reference number 1, which corresponds to a selected cutting depth of T, and the lowered position is indicated by the reference number 0, which corresponds to a cutting depth of 0 (FIGS. 3A to 3D). The signals from the inclination sensor 18 are indicated in the columns NL (inclination to the left) and NR (inclination to the right). The columns $KS_L$ and $KS_R$ indicate the signals that are generated by the means 19 for monitoring the positions of the left-hand and the right-hand edge protection 7L and 7R. An arrow pointing upwards signifies an upward movement while an arrow pointing downwards signifies a downward movement of the left-hand or the right-hand edge protection 7L, 7R in relation to the machine frame 1, when the road cutting machine passes over the positions A to H.

If the left-hand and the right-hand running gear 4L, 4R are in a raised position and the inclination sensor 18 generates a signal indicating an inclination to the left (line 1), the control unit activates the left-hand raising device 10L in such a way that the left-hand running gear 4L is moved out of its raised position 1 in relation to the machine frame into the lowered position 0 (FIG. 3D). If, on the other hand, the inclination sensor generates a signal indicating an inclination to the right (line 2), the right-hand running gear 4R is moved from its raised position 1 into the lowered position 0 (FIG. 3B).

The control actions for changing the running gears into their lowered positions can be seen in the same way (lines 7 and 8).

However, operating conditions can also arise that require control actions that cannot be clearly allocated to individual operating conditions on the basis of signals from the inclination sensor 18. These operating conditions are shown in lines 3 to 6. These operating conditions are characterised by the fact that one of the two running gears is raised and other is lowered.

A clear allocation is possible by determining the position or the movement of the left-hand or the right-hand edge protection 7L, 7R at the moment of tilting at the positions B, D, F and H (FIGS. 4A and 4B), that is to say at an upwards or a downwards movement of the edge protection in relation to the machine frame.

It is clear from the figures that the edge protection reacts in different ways when passing over the individual change points A to H. It can be assumed for example that the left-hand running gear 4L is raised and the right-hand running gear 4R is lowered (lines 3 and 4), which is shown in FIG. 3B. This situation arises, for example, if the road cutting machine moves into the positions B and H, that is to say the left-hand running gear 4L drives into a depression in the ground (Position B) or the right-hand running gear 4R approaches a shoulder (position H). Furthermore, it can be assumed the road cutting machine tilts to the left, which is the case in the positions B and H. If, when passing over the change point B with the left-hand running gear 4L, the left-hand edge protection 7L moves upwards (line 3), the left-hand running gear 4L is lowered (position B). On the other hand, if the right-hand edge protection 7R moves downwards (line 4), the right-hand running gear 4R is raised. The operating conditions in lines 5 and 6 are repeated in a similar manner.

If the edge protection is raised at the moment of tilting, the control unit detects that the running gear is approaching a depression in the ground, while if the edge protection is lowered it detects that a shoulder is being approached with the respective left or right-hand running gear. This can be explained by the fact that the edge protection extending beyond the running gear in the direction of working still maintains its position in relation to the ground, as it is still in contact with the ground, but its position in relation to the machine frame is changed if the machine starts to tilt.

The means 17 for determining an increase or a reduction in the ground level, in other words for identifying a depression or a shoulder in the ground, comprise a sensor 19 that is allocated to the left-hand or the right-hand edge protection 7L, 7R, in order to be able to determine the height of the left-hand and/or the right-hand edge protection thus enabling the position and/or the movement of the edge protection to be identified.

In a first embodiment of the control unit, a sensor is allocated to the left-hand and the right-hand edge protection 7L, 7R. In this case, all that is required from the sensor is to establish whether the left-hand or the right-hand edge protection moves in relation to the machine frame. The direction of the movement, that is, whether it is upwards or downwards in relation to the machine frame, does not need to be determined. This simplifies the design of the sensor. Nevertheless, as can be seen from FIG. 6, a clear allocation is possible.

In an alternative embodiment, one sensor is allocated to either just the left-hand or just the right-hand edge protection. However, in this embodiment, the left-hand or the right-hand sensor also determines the upward or downward direction of movement, whereby with this additional determination of the direction of movement, a clear allocation to the different operating conditions is possible, as is shown in FIG. 6.

A tilting movement leads to a movement of the edge protection on both sides. However, because of the tilting point at the point of contact between the running gear and the ground, at which there is no change in the height of the ground surface, the movement at the opposing edge protection is much greater.

In the preferred embodiment therefore, both movements are determined and rendered plausible in the control system, in order to achieve the maximum amount of redundancy in the interpretation of the operating conditions.

It can be seen, on the basis of the clear allocation of the individual operating conditions to the respective control actions, that even under changing ground conditions a largely uniform working result can be achieved over the entire surface that is to be worked.

What is claimed is:

1. A self-propelled building machine, comprising:

a machine frame;

at least one left-hand running gear and at least one right-hand running gear relative to a direction of working, the running gears configured to support the machine frame from a ground surface;

at least one working roller provided on the machine frame and configured to engage and work the ground surface;

an adjustable support system including left and right adjustable supports configured to raise and lower each of the left-hand and right-hand running gears, respectively, relative to the machine frame, to adjust a milling depth of the working roller;

a sensor system configured to detect a sudden step increase in a height of the ground surface as the building machine moves from a previously cut section across the sudden step increase and up onto to a previously uncut section of an area of the ground surface to be worked, the sudden step increase extending transverse to the direction of working, and to generate a control signal indicative of the presence of the step increase in height of the ground surface; and a control unit configured to receive the control signal from the sensor system and to activate the adjustable support system to raise the running gears in response to the control signal, the control unit having a control mode in which the control unit is configured such that as the building machine moves from the previously cut section to the previously uncut section, the working roller is maintained at an elevation of the previously cut section by increasing the milling depth from zero to a predetermined milling depth value equal to a previously determined height of the previously uncut section relative to the previously cut section so that the previously uncut section is cut down to the same elevation as the previously cut section.

2. The self-propelled building machine of claim 1, wherein:

the sensor system is configured to identify an increase in the height of the ground surface when crossing from a lower level to a higher level, and to identify a reduction in the height of the ground surface when crossing from a higher level to a lower level.

3. The self-propelled building machine of claim 1, wherein:

the sensor system includes a lateral inclination sensor configured to detect a lateral inclination of the building machine.

4. The self-propelled building machine of claim 1, wherein:

the sensor system includes a camera.

5. The self-propelled building machine of claim 1, wherein:

the sensor system includes an ultra-sonic sensor.

6. The self-propelled building machine of claim 1, wherein:

the sensor system includes at least one non-contacting sensor configured to detect a distance between a reference point on the machine frame and the ground surface.

7. The self-propelled building machine of claim 1, further comprising:

at least one edge protection extending in the direction of working adjacent at least one side of the working roller; and wherein the sensor system includes an edge protection sensor configured to detect a height of the at least one edge protection in relation to the machine frame.

8. The self-propelled building machine of claim 1, wherein:

the control unit is configured such that no further material is cut from the previously cut section.

9. The self-propelled building machine of claim 1, wherein:

the transverse extending sudden step increase extends obliquely to the direction of working.

10. A self-propelled building machine, comprising:

a machine frame;

at least one left-hand running gear and at least one right-hand running gear relative to a direction of working, the running gears configured to support the machine frame from a ground surface;

at least one working roller provided on the machine frame and configured to engage and work the ground surface;

an adjustable support system including left and right adjustable supports configured to raise and lower each of the left-hand and right-hand running gears, respectively, relative to the machine frame, to adjust a milling depth of the working roller;

a sensor system configured to detect sudden step changes up and down in a height of the ground surface as the milling machine moves from a previously cut section of material across an island of uncut material, the sudden step changes extending transverse to the direction of working, and to generate control signals indicative of the presence of the sudden step changes in height of the ground surface; and a control unit configured to receive the control signals from the sensor system and to activate the adjustable support system to raise and lower the running gears in response to the control signals received from the sensor system, the control unit having a control mode in which the control unit is configured such that the milling depth is changed from zero to a predetermined depth equal to the height of the island and then back to zero as the milling machine moves from the previously cut section of material across the island of uncut material so that the building machine mills off the island.

11. The self-propelled building machine of claim 10, wherein:

the control unit is configured such that as the milling machine moves across the previously cut section no further material is cut from the previously cut section.

12. The self-propelled building machine of claim 10, wherein:

the sensor system is configured to identify an increase in the height of the ground surface when crossing from a lower level to a higher level, and to identify a reduction in the height of the ground surface when crossing from a higher level to a lower level.

13. The self-propelled building machine of claim 10, wherein:

the sensor system includes a lateral inclination sensor configured to detect a lateral inclination of the building machine.

14. The self-propelled building machine of claim 10, wherein:

the sensor system includes a camera.

15. The self-propelled building machine of claim 10, wherein:

the sensor system includes an ultra-sonic sensor.

16. The self-propelled building machine of claim 10, wherein:

the sensor system includes at least one non-contacting sensor configured to detect a distance between a reference point on the machine frame and the ground surface.

17. The self-propelled building machine of claim 10, further comprising:

at least one edge protection extending in the direction of working adjacent at least one side of the working roller; and wherein the sensor system includes an edge protection sensor configured to detect a height of the at least one edge protection in relation to the machine frame.

18. The self-propelled building machine of claim 10, wherein:

the transverse extending sudden step changes extend obliquely to the direction of working.

19. A method of operating a self-propelled milling machine in an area of a ground surface including previously milled sections and previously unmilled sections, the milling machine including a cutting roller and a plurality of running gears, the method comprising:

(a) detecting sudden changes in a height of the ground surface extending transverse to a direction of working of the milling machine by using a sensor as the milling machine moves from a previously milled section across one of the unmilled sections and processing signals from the sensor and thereby identifying the sudden changes in the height of the ground surface; and (b) maintaining an elevation of the cutting roller in relation to the ground surface in the previously milled section as the milling machine moves from the previously milled section across one of the unmilled sections so that no further material is milled off of the previously milled section and so that the unmilled section is milled down to the same elevation as the previously milled section, the maintaining step further including adjusting one or more height adjustable supports between the running gears and a machine frame of the building machine in response to the signals of step (a), and thereby maintaining the elevation of the cutting roller in relation to the ground surface in the previously milled section.

20. The method of claim 19, wherein:

in step (a) the sensor includes a camera, and the detecting step further comprises using the camera to study the ground surface; and the processing of signals in step (a) includes processing images from the camera.

21. The method of claim 19, wherein:

the detecting step further comprises using the sensor to study the ground surface.

22. The method of claim 19, wherein in the detecting step the sensor is an ultra-sound sensor.

23. The method of claim 19, wherein:

the detecting step further comprises using the sensor to determine a reaction of the building machine to the changes in the height of the ground surface.

24. The method of claim 23, wherein:

the detecting step further comprises determining a lateral inclination of the building machine.

25. The method of claim 23, wherein:

the detecting step further comprises determining whether the height of the ground surface is increasing or decreasing.

26. The method of claim 19, further comprising:

continuing to maintain the elevation of the cutting roller in relation to the ground surface in the previously milled section as the milling machine moves from the one of the unmilled sections onto a second one of the previously milled sections, so that no further material is milled off of the second one of the previously milled sections.

27. The method of claim 19, wherein:

in step (a) the transverse extending sudden changes in height extend obliquely to the direction of working.

* * * * *